US007081866B2

(12) United States Patent
Gaechter

(10) Patent No.: US 7,081,866 B2
(45) Date of Patent: Jul. 25, 2006

(54) METHOD FOR ORIENTING A HEXAPOD TURRET

(75) Inventor: Jean Pierre Gaechter, Rebigue (FR)

(73) Assignee: IN-SNEC, L'Orgueilleuse ( * ) Notice: Subject to any disclaimer, the term of this patent is extended or adjusted under 35 U.S.C. 154(b) by 0 days.

(21) Appl. No.: 10/479,648

(22) PCT Filed: May 30, 2002

(86) PCT No.: PCT/FR02/01816

§ 371 (c)(1),
(2), (4) Date: Aug. 9, 2004

(87) PCT Pub. No.: WO02/097920

PCT Pub. Date: Dec. 5, 2002

(65) Prior Publication Data

US 2004/0244525 A1 Dec. 9, 2004

(30) Foreign Application Priority Data

May 31, 2001 (FR) ..... 01 07136

(51) Int. Cl.
*H01Q 1/08* (2006.01)

(52) U.S. Cl. ..... 343/880; 343/832; 343/912

(58) Field of Classification Search ..... 343/832, 343/878, 880, 882, 912
See application file for complete search history.

(56) References Cited

U.S. PATENT DOCUMENTS 4,771,585 A * 9/1988 Onoda et al. ..... 52/646
5,604,593 A * 2/1997 McMurtry ..... 356/496
6,041,500 A * 3/2000 Terpstra ..... 29/889.21
6,542,132 B1 * 4/2003 Stern ..... 343/915

* cited by examiner

*Primary Examiner*—Shih-Chao Chen
(74) *Attorney, Agent, or Firm*—Blakely Sokoloff Taylor & Zafman

(57) ABSTRACT

The invention relates to a method for displacing a moving plate (20) of a hexapod (100) whose legs (1, 2, 3, 4, 5, 6) are provided with a length adjusting device from an orientation $V_i$ which is defined by the azimuth-elevation coordinates thereof ($\alpha_i$, $\beta_i$) towards an orientation $V_{i+1}$ which is defined by the azimuth-elevation coordinates thereof ($\alpha_{i+1}$, $\beta_{i+1}$), characterized in that it comprises stages wherein: a law is defined which defines an offset distance d according to the orientation of the plate (20); the offset distance corresponding to the orientation $V_{i+1}$ is determined; the adjustment devices are controlled in order to modify the lengths $L_1$–$L_6$ of the legs (1, 2, 3, 4, 5, 6) in order to displace the moving plate (20) from orientation $V_1$ to orientation $V_{i+1}$ and to offset it in relation to the normal on the fixed base (10) of the hexapode (100) via the centre OA of said base (10) on the azimuth plane of $V_{i+1}$ of the distance d.

25 Claims, 14 Drawing Sheets

METHOD FOR ORIENTING A HEXAPOD TURRET

Figure 1:
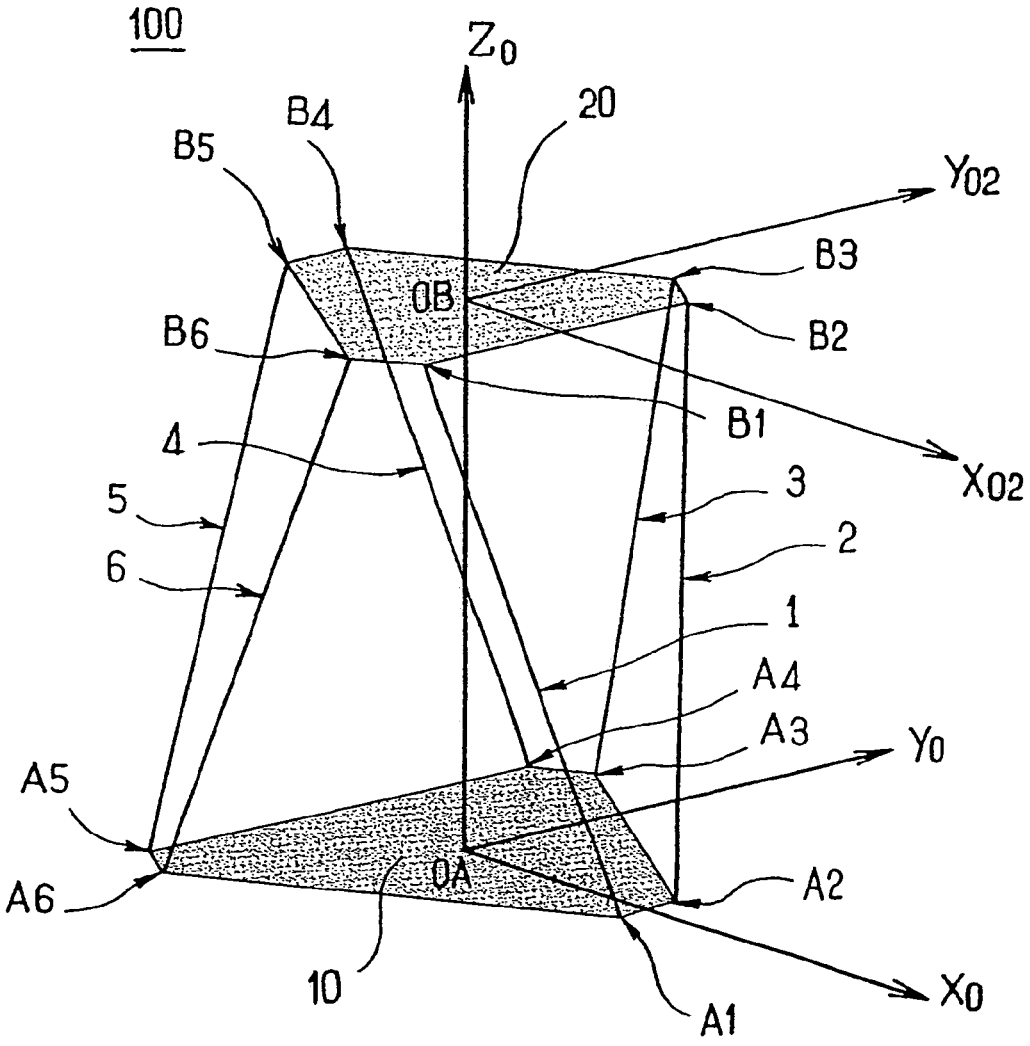

This application is a 371 of PCT/FR02/01816 filed on May 30, 2002.

This invention relates to the application of hexapod turrets to plotting equipment such as antennae, optronic apparatus or telescopes, optical measuring or telecommunications instruments or any device whose function requires being oriented in space.

The hexapod turrets or Stewart or Gough platforms are devices generally utilised as supports for antennae or telescopes, enabling their orientation to be adjusted. Patent EP 0 515 888, filed on May 12, 1992 in the name of ANT NACHRICHTENTECH, describes an example of a plotting device comprising a hexapod turret. A hexapod turret comprises a platform or fixed base, a moving plate on which is fixed the device to be oriented and six legs of adjustable length joining the moving plate to the base. The ends of the legs are fixed in pairs by means of cardan type links on the moving plate and the base such that the legs form triangles. Each leg comprises two nested tubes which can slide relative to one another. These tubes are activated by linear piezoelectric motors which allow the length of the leg to be adjusted. Such a device enables the moving plate to be moved by six degrees of liberty.

In patent EP 0 515 888 the hexapod turret described is fixed on a satellite and its role is essentially to "bring out" the equipment of the volume of the satellite to obtain a clear view and also to orient it, but with low clearance.

The aim of the invention is to utilise a hexapod device to orient equipment with considerable clearance and a view on at least 2n steradians so as to cover at least the demi-space above the horizon.

The problem posed by using a hexapod structure is that it loses its rigidity when the angles between two legs of the same articulation and the perpendicular to the plane of the fixed base or of the moving plate approach 90°; this phenomenon is currently known as the "toggle joint" effect.

A further aim of the invention is to be able to orient equipment in all directions of the demi-space by preserving good rigidity right through.

For this purpose, the invention proposes a process for moving the moving plate of a hexapod whose legs are fitted with a length-adjusting device, from an orientation $V_1$ defined by its azimuth-elevation ($\alpha_i$, $\beta_i$) coordinates towards an orientation $V_{i+1}$ defined by its azimuth-elevation ($\alpha_{i+1}$, $\beta_{i+1}$) coordinates, characterised in that it comprises stages wherein:

a law is defined which defines an offset distance d according to the orientation of the plate, the offset distance corresponding to the orientation $V_{i+1}$ is determined, the adjustment devices are controlled in order to modify the lengths $L_1$ to $L_6$ of the legs in order to displace the moving plate from orientation $V_i$ to orientation $V_{i+1}$ and to offset it in relation to the perpendicular in the fixed base of the hexapod via the centre OA of said base on the azimuth plane of $\alpha_{i+1}$ of $V_{i+1}$ of the distance d.

This process advantageously allows the plate of the hexapod to be positioned at an offset, effectively avoiding singular points, that is, positions in which the hexapod turret loses its rigidity.

Highly preferably, an offset law is defined giving a unique position of the centre OB of the plate in space as a function of its orientation. This law defines a geometric surface known as "offset surface" on which the centre OB of the plate evolves.

According to variations of this process:

the law of offset defines a continuous geometric surface, the offset surface is a plane, the offset surface is a portion of a sphere.

The moving plate can be displaced by controlling rotation of the moving plate according to an axis perpendicular to the plane containing the pointing vectors $V_i$ and $V_{i+1}$.

The variation in length of the legs of the hexapod can be advantageously determined according to the following steps:

a reference position of the hexapod is defined according to which all the legs are adjusted to the same length $L_0$, the variation in length of each leg is determined so that the moving plate of the hexapod moves from the reference position to the pointing direction $V_{i+1}$ by virtual rotation in the azimuth plane $\alpha_{i+1}$, and by virtual translation of the centre OB of the plate towards an offset surface defined by the offset law, a variation in total length is deduced therefrom for each leg to switch from direction $V_i$ to direction $V_{i+1}$.

This control process in variation in length of the legs avoids configurations of the hexapod turret which would risk diminishing its rigidity and damaging the mechanisms of the legs by collision.

In an embodiment of the invention, the overall movement of orientation of the moving plate is decomposed in a succession of unit displacements of azimuth $\Delta\alpha$ and elevation $\Delta\beta$ of the moving plate. For each unit displacement, the overall displacement process (determination of a virtual rotation followed by virtual translation) is reproduced.

This division in units $\Delta\alpha$ and $\Delta\beta$ prevents the plate from passing via singular point during its passage from one position to the other. In this way, it is ensured that during the movement of the moving plate, the hexapod turret is always in a stable configuration.

The process can advantageously be completed by the following steps:

the adjustment devices are controlled as a function of the lengths L of the legs to be obtained and in that this calculation takes into consideration the relative angles between the elements making up joints joining the legs to the plate and to the fixed base, the angles formed by the axes of the legs and the perpendicular to the plane of the fixed base and the angles formed by the axes of the legs and the perpendicular to the plane of the moving plate are always less than a maximum angle defined between 40 and 80 degrees.

The invention also proposes a device for displacing the moving plate of a hexapod, characterised in that each leg of the hexapod comprises a jack comprising a first and a second assembly capable of sliding relative to one another, an actuator whose exit axis drives in rotation a screw arranged parallel or perpendicular to the axis of the motor, said screw extending in the length of the first assembly and able to pivot inside a nut mounted solid with the second set, rotation of the screw in the nut causing translation of the second assembly relative to the first set.

The device can be completed by the following characteristics:

the device comprises means for measuring the position of the axis of the motor, connections are arranged on the fixed base according to a first circle of radius RA and connections are arranged on the moving plate according to a second circle of radius RB, the ratio RA/RB being substantially equal to 1.5, the links are arranged in pairs on the moving plate or on the fixed base according to circle of radius R, the distance between two links of the same pair being substantially equal to R/10, maximum elongation of one leg is less than 2, maximum elongation of one leg is greater than 1.7.

These different characteristics especially allow significant clearances to be obtained.

Figure 2:
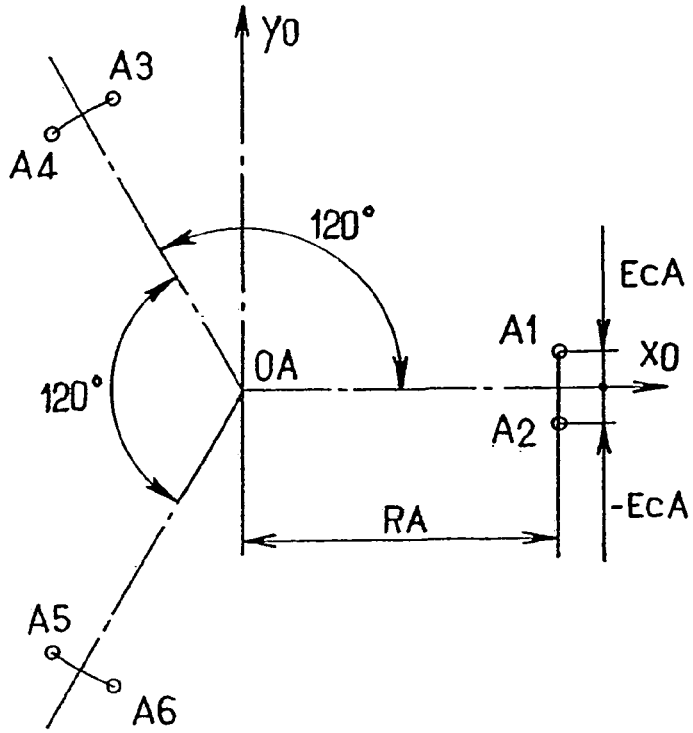
Figure 3:
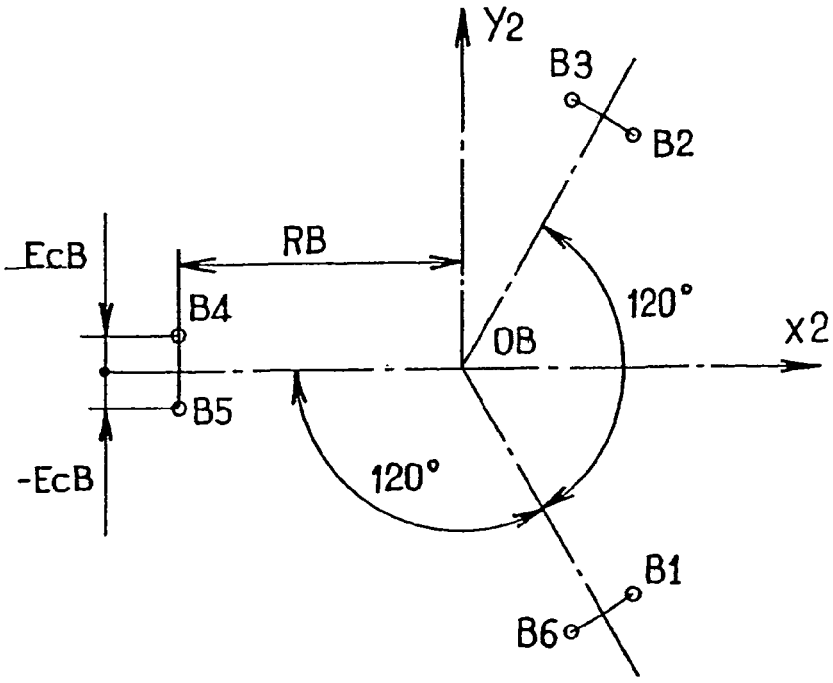
Figure 4:
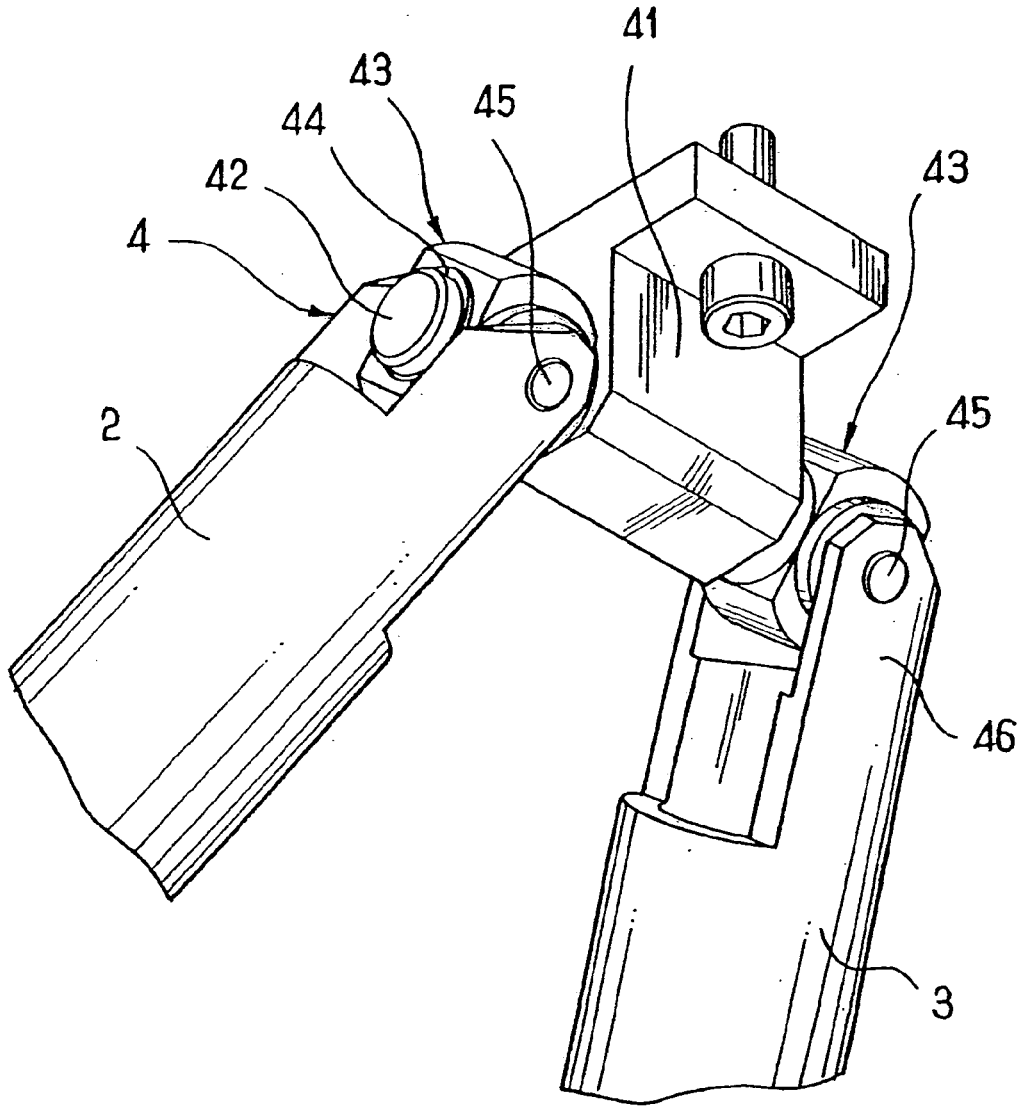
Figure 5:
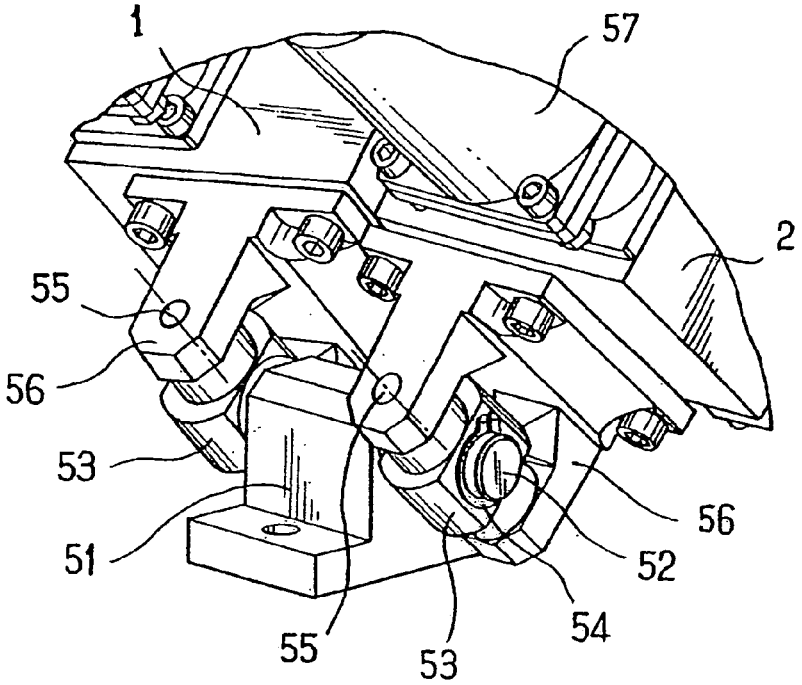
Figure 6:
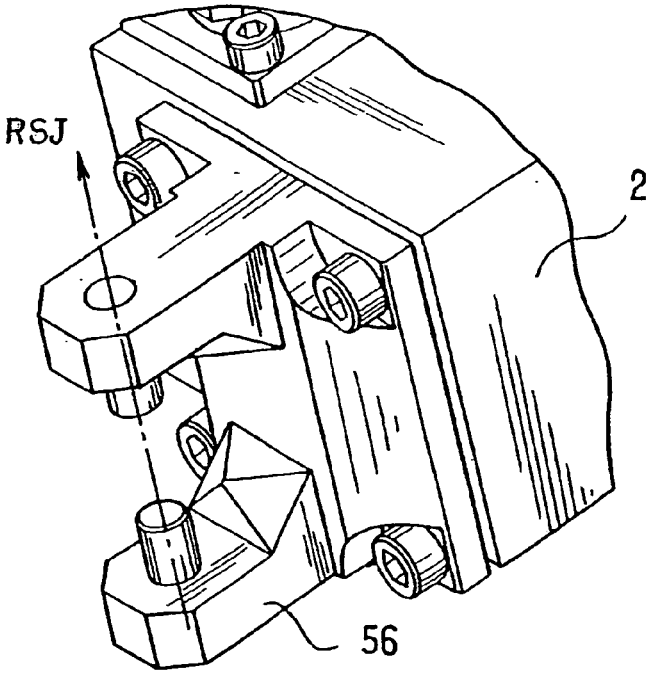
Figure 7:
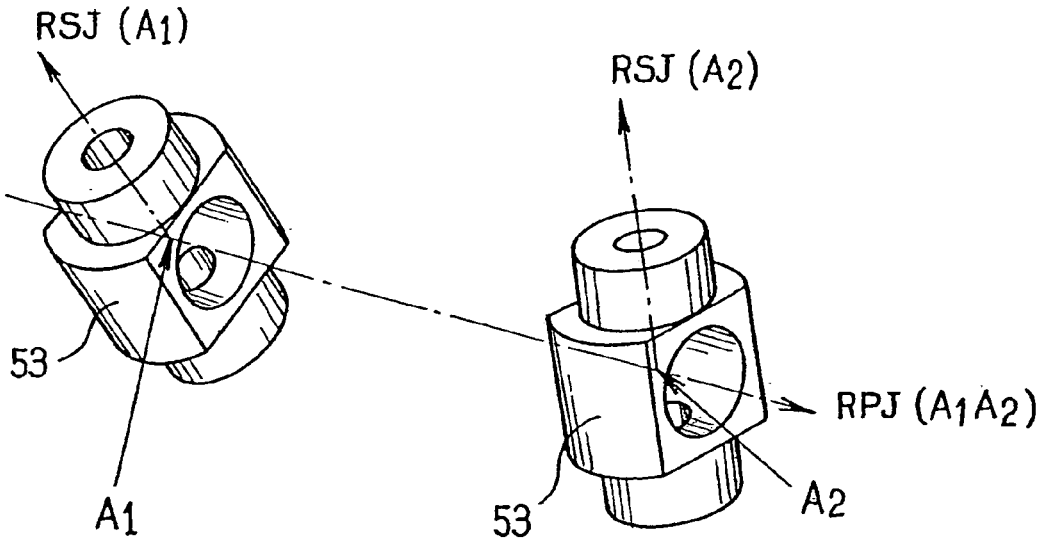
Figure 8:
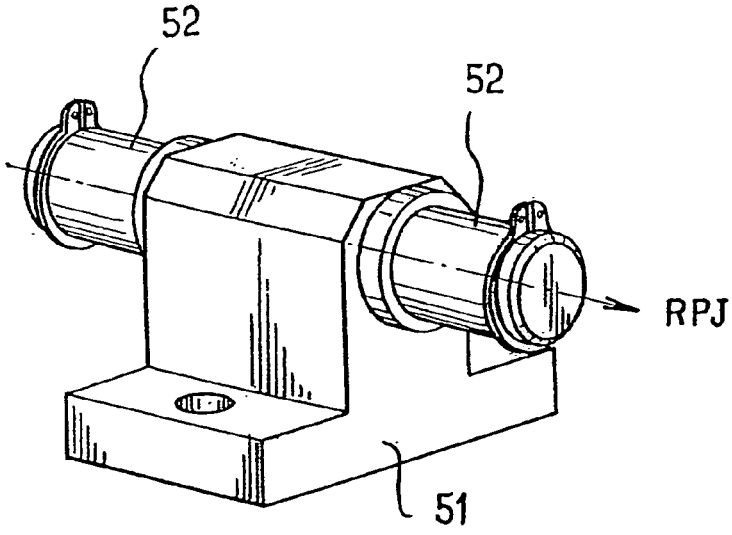
Figure 9:
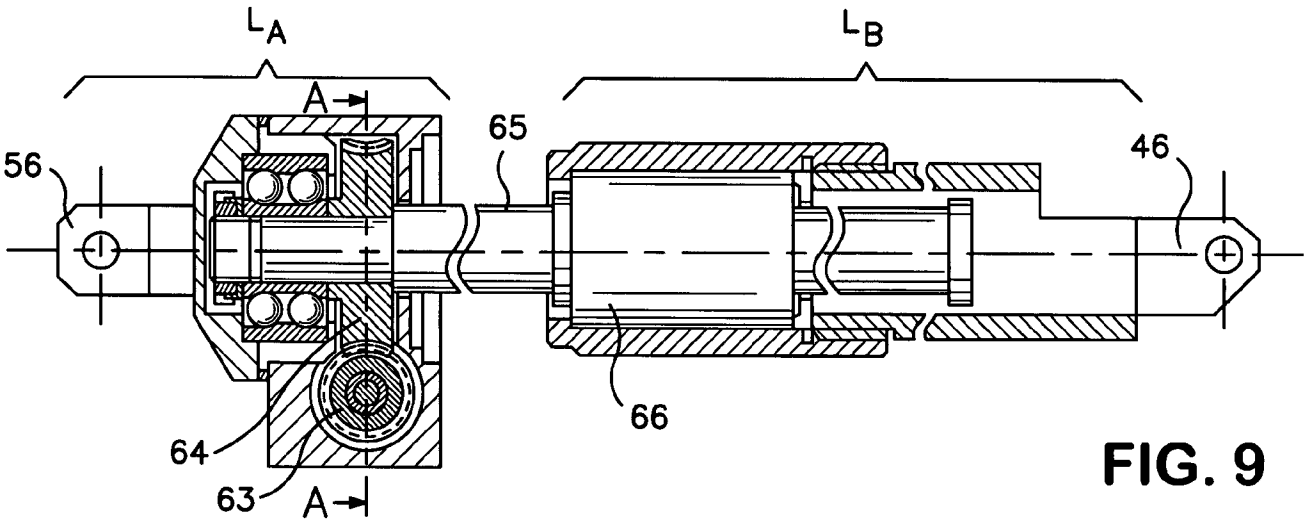
Figure 9A:
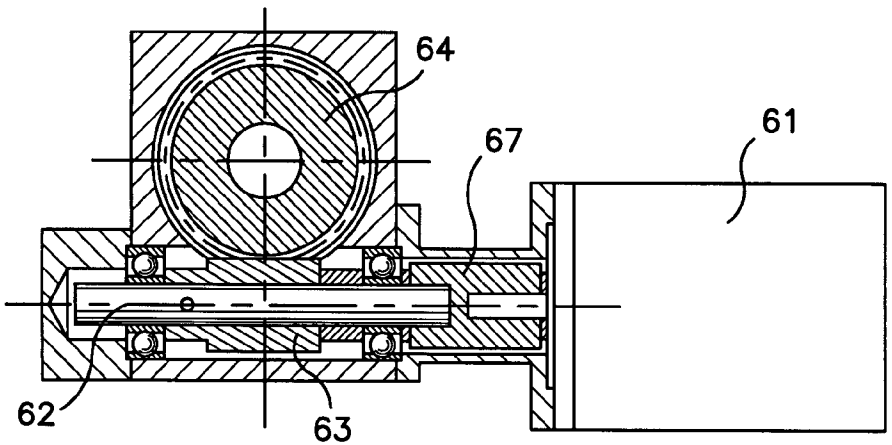
Figure 10:
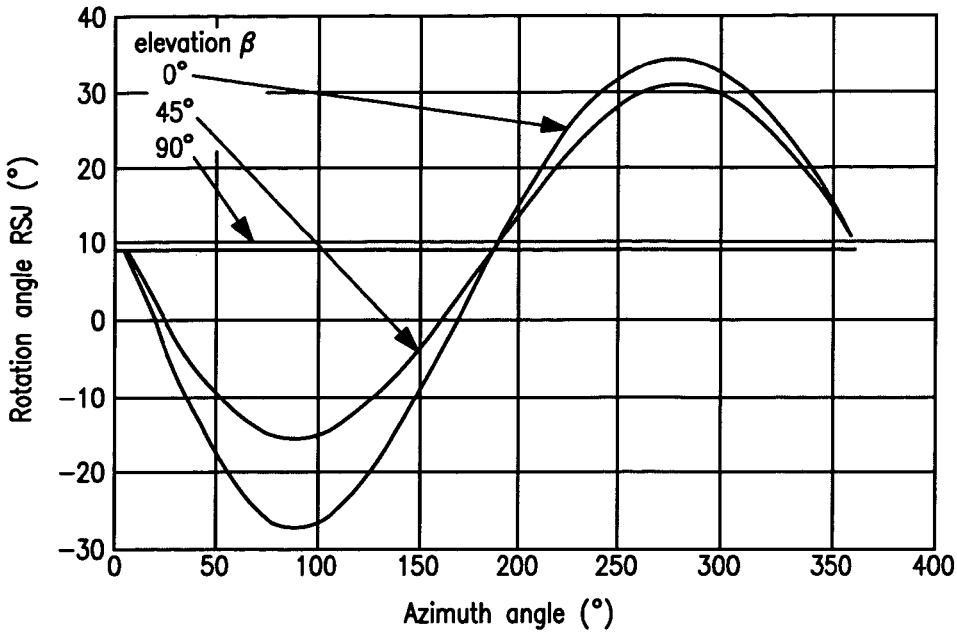
Figure 11:
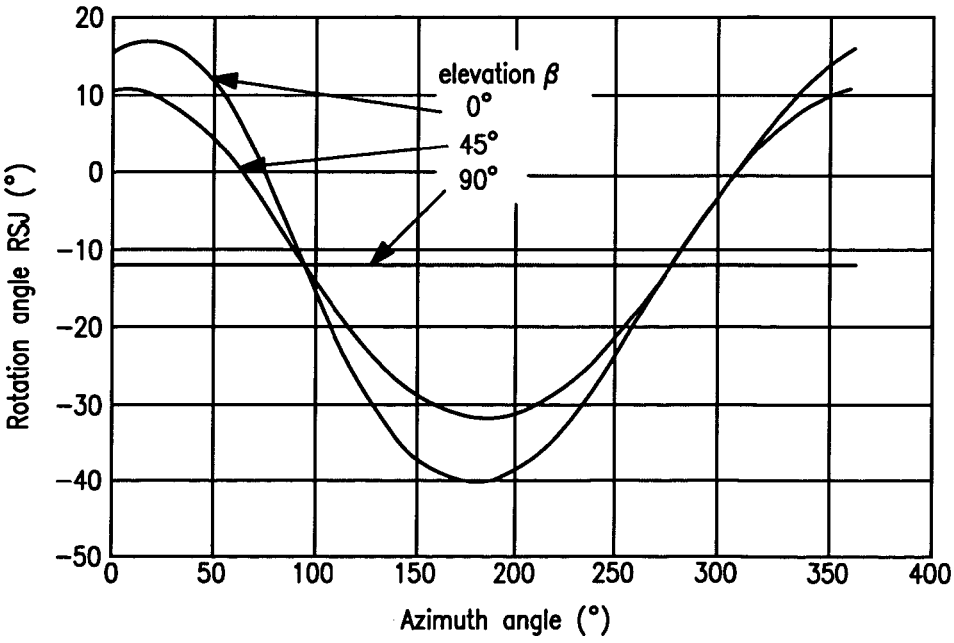
Figure 12:
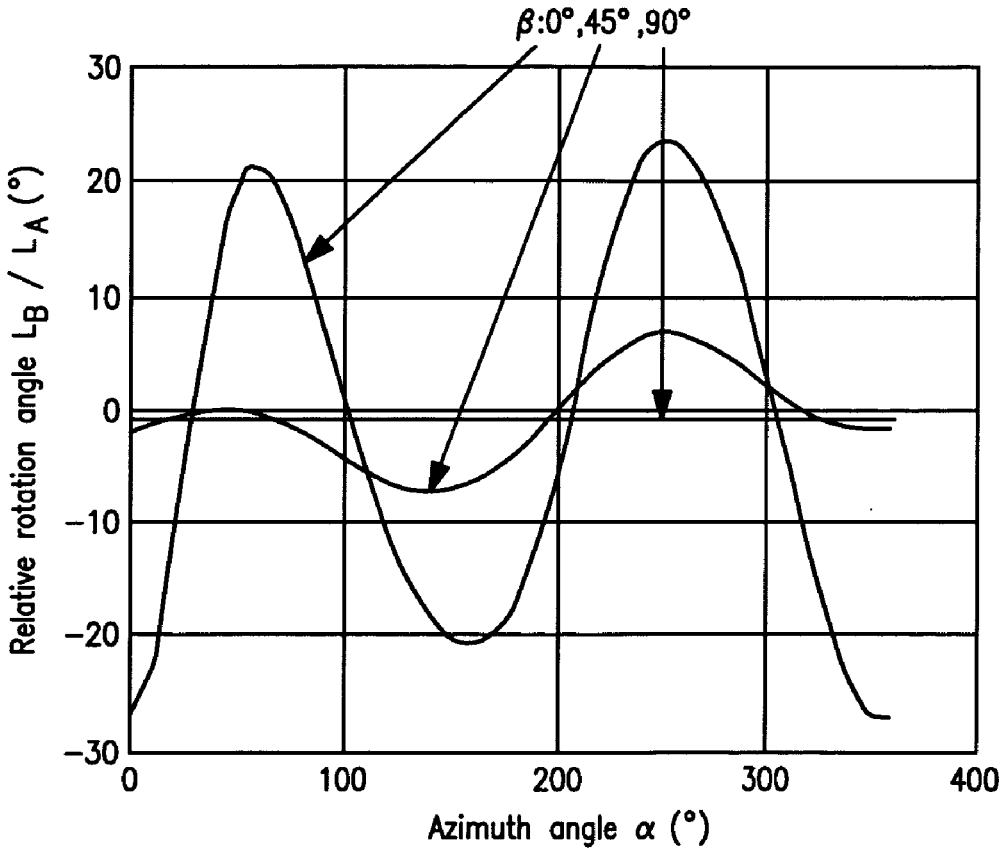
Figure 13:
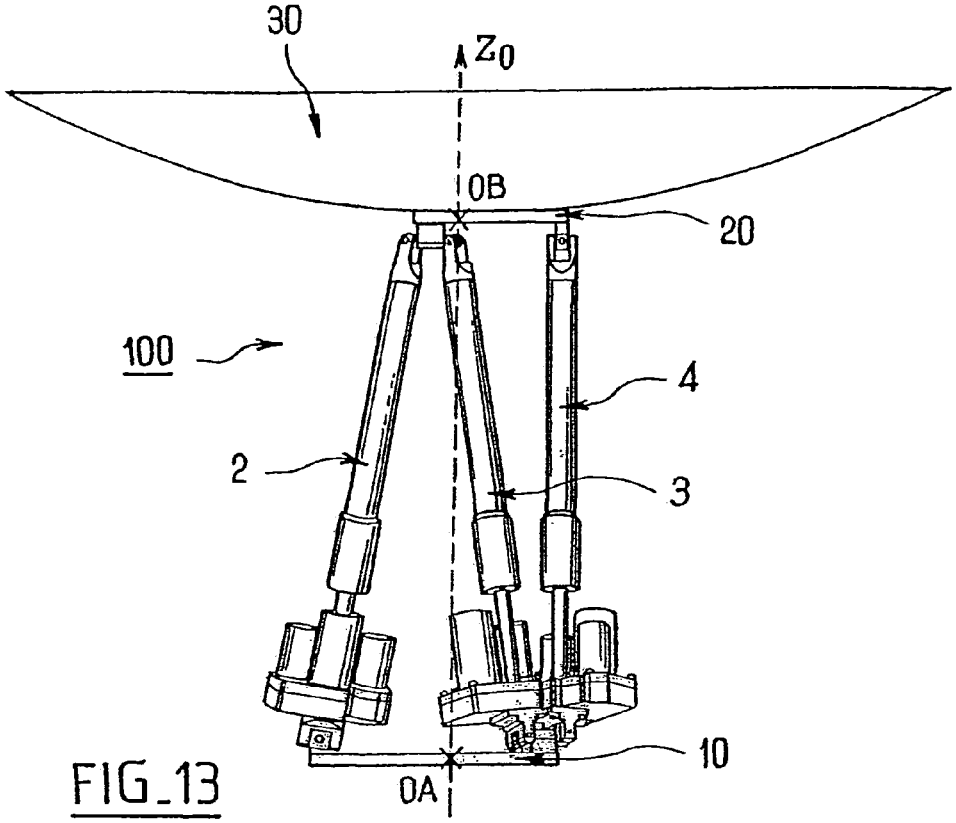
Figure 14:
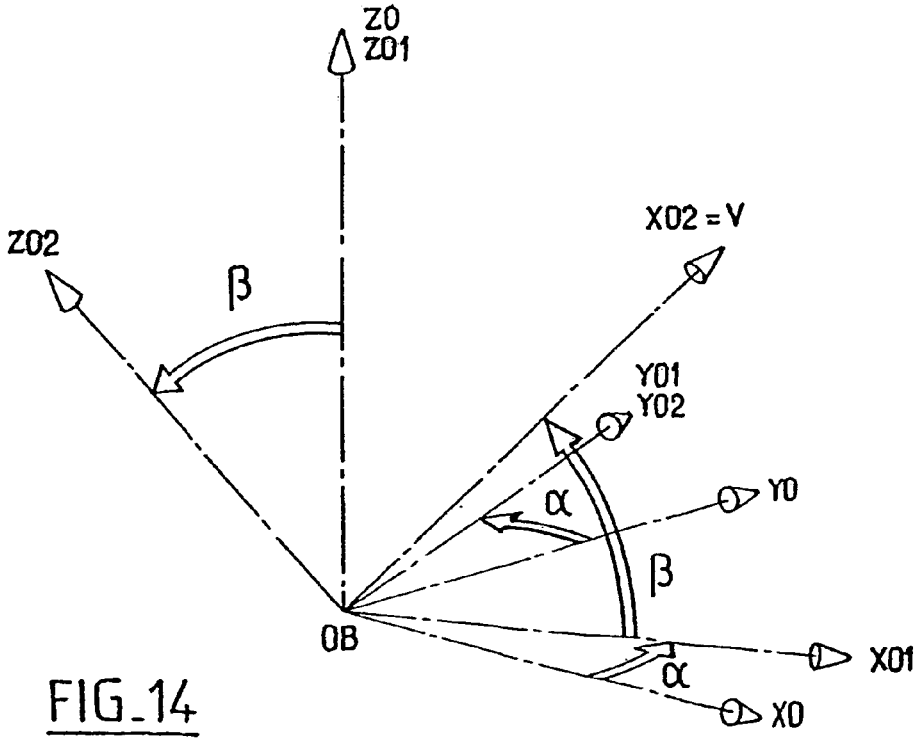
Figure 15:
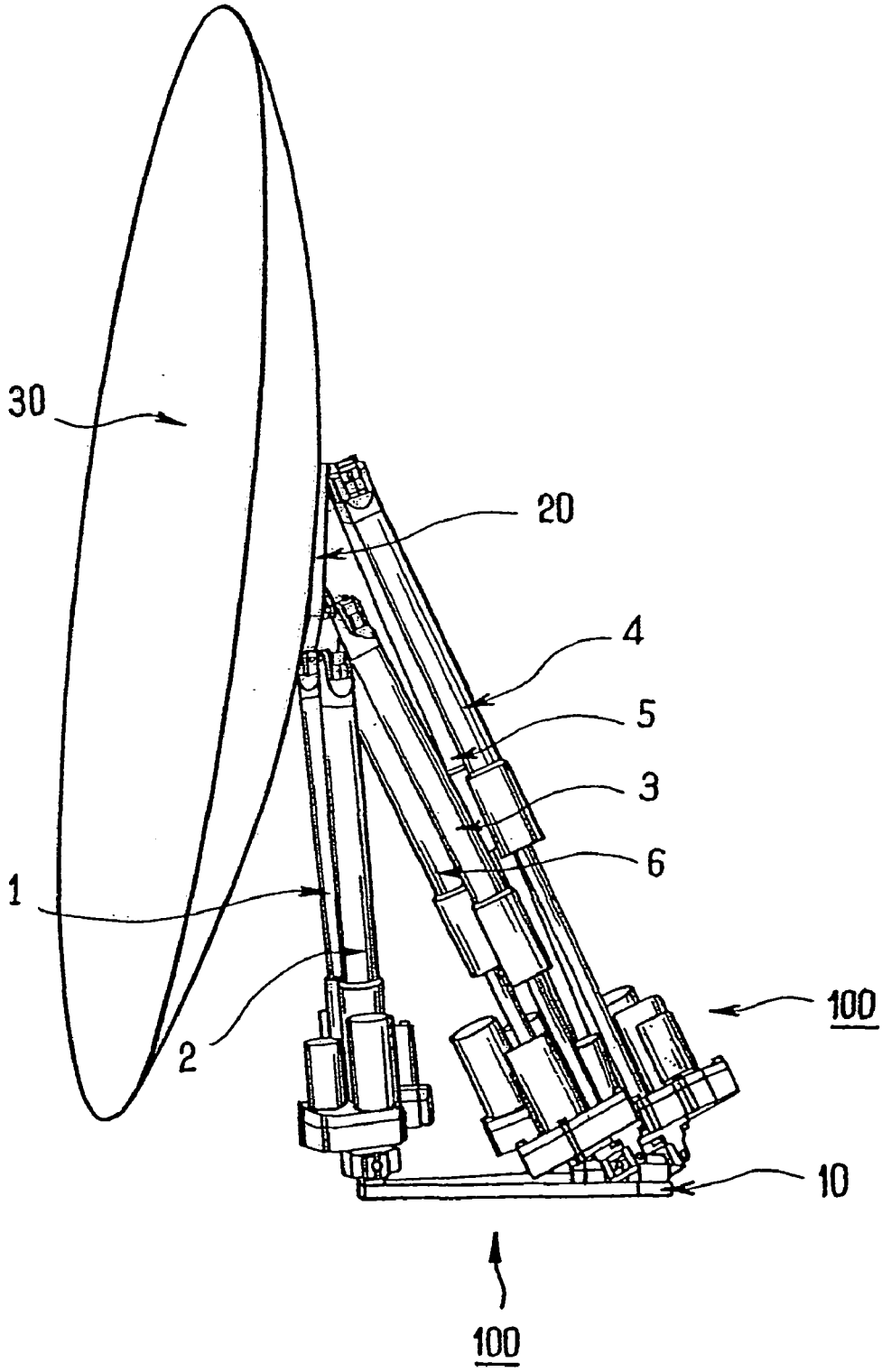
Figure 16:
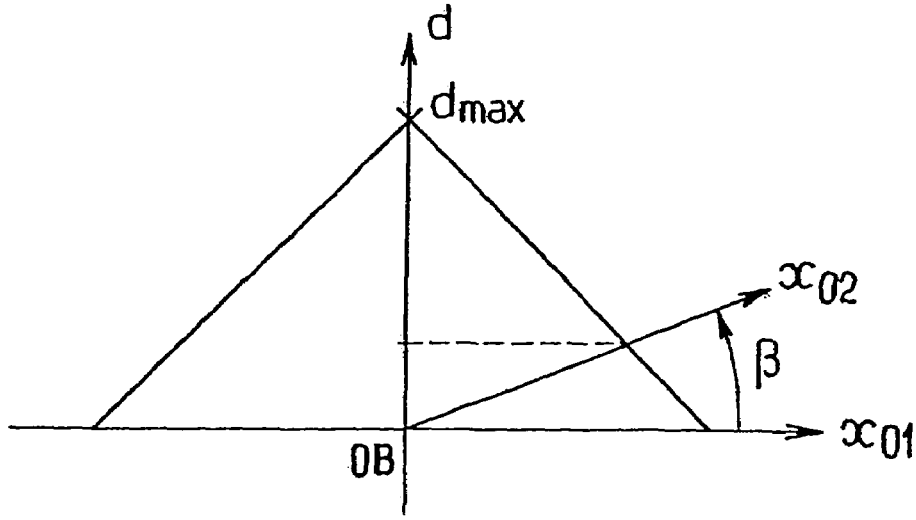
Figure 17:
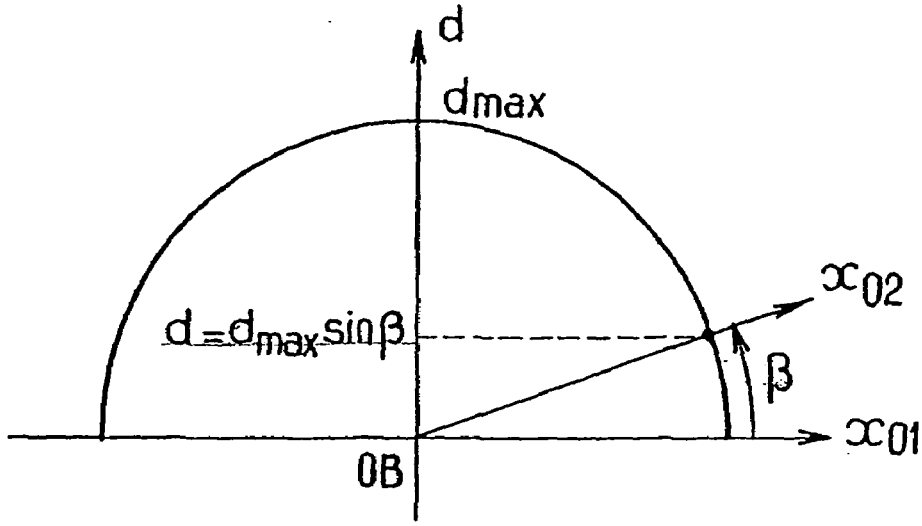
Figure 18:
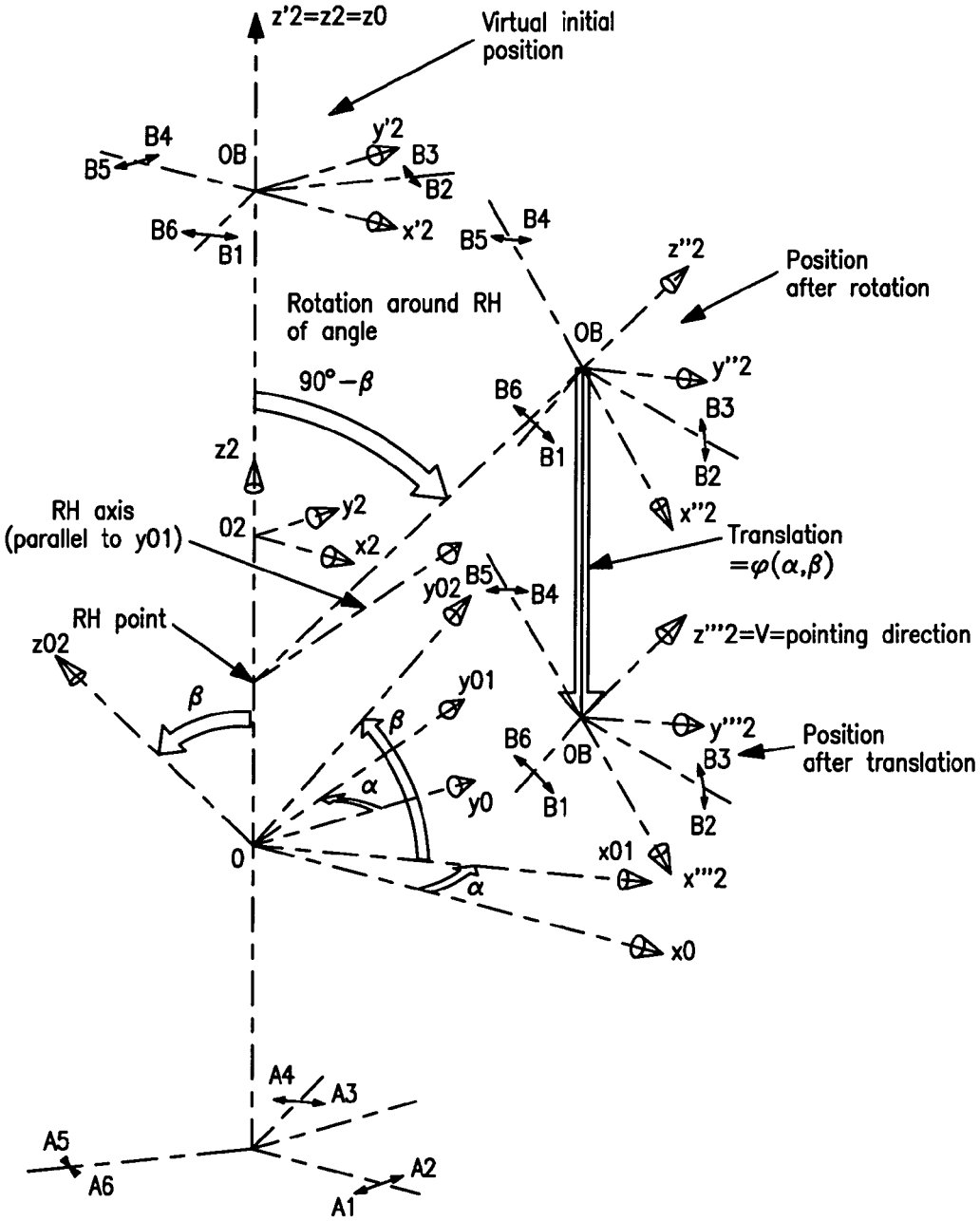
Figure 19:
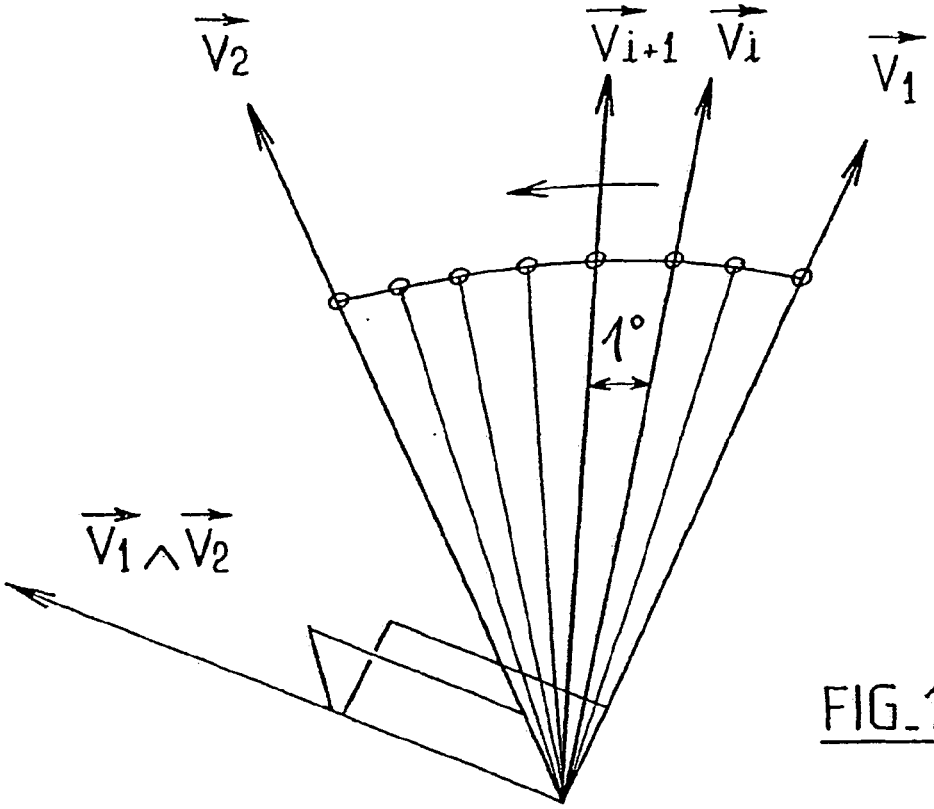
Figure 20:
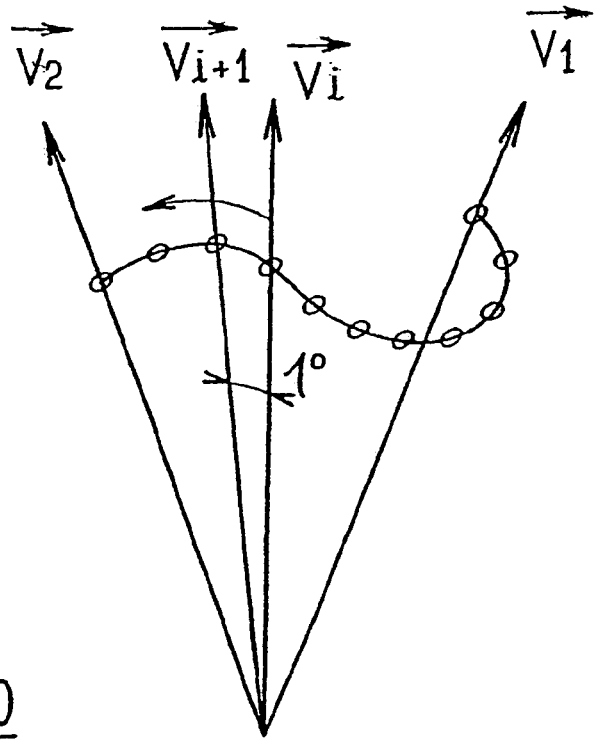
Figure 21:
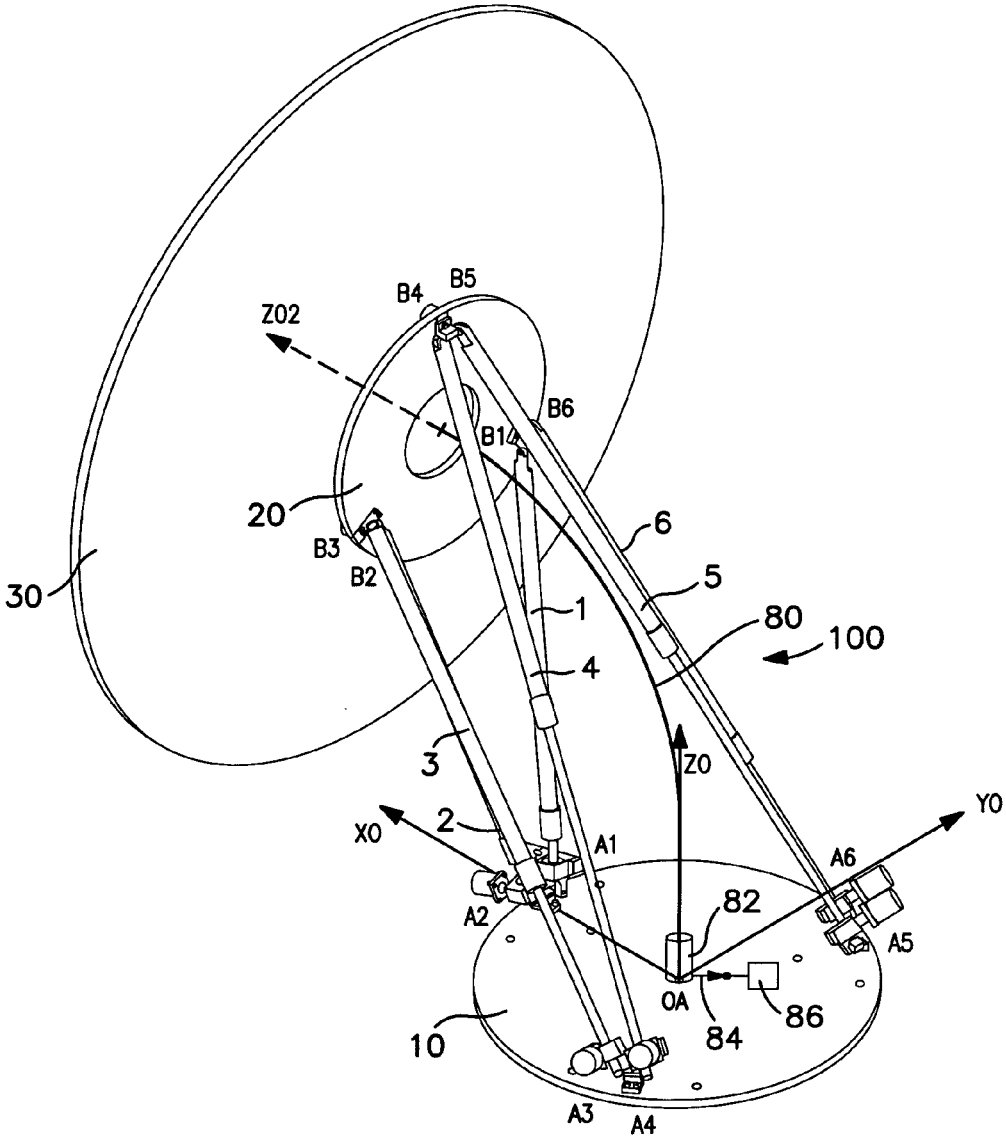

Other characteristics and advantages will emerge from the following description, which is purely illustrative and non-limiting and must be read with reference to the attached figures, in which FIG. 1 is a kinematic representation of a hexapod turret, FIG. 2 illustrates the distribution on the fixed base of the links between the legs and the fixed base, FIG. 3 illustrates the distribution on the moving plate of the links between the legs and the moving plate, FIG. 4 illustrates an example of linking between the moving plate and a pair of legs, FIG. 5 illustrates an example of linking between the fixed base and a pair of legs, FIGS. 6 to 8 illustrate the different mechanical elements used in the links of FIGS. 4 and 5, FIG. 9 is a sectional view of a length-adjusting device for a jack, FIG. 9*a* is a sectional view of the adjustment device of FIG. 9 along line A—A, FIGS. 10 and 11 are graphic representations of the angles of rotation of the elements making up a link between a jack and the base as a function of the orientation of the moving plate, FIG. 12 is a graphic representation of the relative angle of rotation between the two elements making up a leg as a function of the orientation of the moving plate, FIG. 13 illustrates a hexapod turret on which is mounted a parabolic antenna, in its reference position, FIG. 14 illustrates the system of azimuth-elevation marks utilised to define orientation of the moving plate in space, FIG. 15 illustrates a hexapod turret on which is mounted a parabolic antenna, said turret located in a position approaching an unstable configuration, FIGS. 16 and 17 illustrates examples of offset laws of the moving plate as a function of its elevation, FIG. 18 illustrates a displacement principle of the moving plate of the turret, FIGS. 19 and 20 illustrate possible displacement trajectories of the turret, FIG. 21 illustrates an example for implementing control means of the functioning of the hexapod turret.

In FIG. 1 the hexapod turret 100 comprises a base 10 and a moving plate 20 joined by six identical jacks 1, 2, 3, 4, 5 and 6 constituting the legs. Each jack i joins a point $A_i$ of the fixed base 10 to a point $B_i$ of the moving plate 20 and is adjusted to a length $L_i$ corresponding to the distance $A_iB_i$. The links between jacks and base 10 as well as the links between jacks and moving plate 20 are formed by twelve joints of cardan type (or universal joint). Each of these joints comprises two elementary axes of rotation intersected at points $A_1$, $A_2$, $A_3$, $A_4$, $A_5$, $A_6$, $B_1$, $B_2$, $B_3$, $B_4$, $B_5$ and $B_6$.

As illustrated in FIG. 2, the points $A_i$ are situated at a distance RA from the centre OA of the fixed base 10 and are distributed in three pairs, pairs ($A_1$, $A_2$), ($A_3$, $A_4$) and ($A_5$, $A_6$) being placed at 120° relative to one another. Similarly in FIG. 3, the points $B_i$ are situated at a distance RB from the centre OB of the moving plate 20 and are distributed in three pairs, pairs ($B_2$, $B_3$), ($B_4$, $B_5$), ($B_6$, $B_1$) being placed at 120° relative to one another. Two jacks originating from one pair of points on the base 10 are always joined at points of distinct pairs on the moving plate 20. In this way, the jacks 1 to 6 converge two by two alternately towards the base 10 or towards the moving plate 20.

FIG. 4 illustrates in greater detail a link at the level of points $B_2$ and $B_3$ between the pair of jacks 2 and 3, and the moving plate 20. Such a link comprises a central support 41 screwed onto the plate 10 and symmetrically carrying two cylindrical axes 42 oriented in accordance with direction $B_2B_3$. Pivoting joints 43 are mounted on the axes 42.

Each joint 43 comprises a bore which permits it to be press-fitted on one of the axes 42 of the central support 41. In this case, a pivot link is established by direct contact between a joint 43 and the surface of an axis 42.

The choice can be made to produce the elements in those materials which would restrict friction: for example the axes 42 are made of steel and the joints of bronze. To further limit friction, this link can also be made by connecting in elements of friction bearing type mounted in the joint 43 or ball or needle bearing. Each joint 43 is stopped in translation on the axis 42 by a circlips 44 mounted in a groove of the axis 42 or by a nut mounted on the threaded end of the axis 42.

The joints 43 further comprise two axes 45 perpendicular to their bore. The ends 46 of the jacks 2 and 3 have a general cap form, constituted by two symmetrical parts inserting the joint 43 and having bores in which the axes 45 of the joint 43 are fitted. The cap-shaped ends 46 of the jacks 2 and 3 have chamfers so as to allow them maximum clearance relative to the joint 43 in all orientation configurations thereof.

FIG. 5 illustrates in greater detail a link at the level of the points $A_1$ and $A_2$ between the pair of jacks 1 and 2, and the fixed base 10. This link is comparable to the link between jacks and moving plate shown in FIG. 4. It comprises a central support 51 screwed onto the base 10 and symmetrically carrying two concentric cylindrical axes 52 oriented to direction $A_1A_2$. Pivoting joints 53 have a bore and two perpendicular axes 55 are mounted on the axes 52. The ends 56 of the jacks 1 and 2 have a general cap shape, constituted by two symmetrical parts inserting a joint 52 and having bores in which the axes of the joint 52 are fitted.

The end parts 56 of the jacks 1 and 2 support a device 57 allowing control of lengths $L_1$ and $L_2$ of the jacks 1 and 2.

FIG. 9 illustrates the jack 1 comprising two assemblies $L_A$ and $L_B$ which can slide relative to one another so as to have the length $L_1$ of the jack 1 vary. The length-adjustment device 57 comprises a stepping motor 61 whose exit axis 62 support an endless screw 63 allowing a toothed wheel 64 arranged perpendicularly to the axis 62 to be rotated. This toothed wheel 64 drives a ballscrew 65 extending in the length of the assembly $L_A$. The assembly $L_B$ comprises a screw 66 mounted solid in which the ballscrew 65 pivots. Rotation of the ballscrew 65 in the nut 66 engenders translation of the nut 66 along the screw 65.

In this adjustment device the screw 65 has a rotation speed proportional to that of the stepping motor 61. To determine the proportionality coefficient between these speeds, it suffices to know the geometric characteristics of the various mechanical components (especially the pitches of the screw 65, of the wheel 64 and of the endless screw 63). Theoretically, controlling the angular position of the exit axis 62 of the motor 61 produces the length $L_1$ of the jack 1. To control this length an automatic open-loop position control of the motor 61 can be used for example, or an absolute position measure of the axis 62 by resolver for closed-loop automatic control. It is also possible to use optic coders, or incremental or absolute coders, single-turn or multi-turn coders.

However, elongating the jack 1 is not directly proportional to the angular size measured by this device. In fact, during variations in position of the moving plate 20, a relative rotation of the $L_A$ and $L_B$ assemblies is caused. This additional rotation modifies the length $L_1$ of the jack 1 by means of the helicoidal link, independently of the action of the motor 61. This effect is taken into account for establish the set-point assigned to the motor. The relative rotations are determined analytically according to the calculated positions of points $B_{1\ to\ B6}$. The intermediary calculations allow the rotations of the elements of the cardan joints to be determined.

FIGS. 6 to 8 illustrate the axes of rotation of the various elements making up the cardan links. The axis RPJ is attached to the central support 41 or 51 and the axes RSJ are attached to the joints 43 or 53.

FIG. 10 graphically illustrates the angle of rotation of the joint 43 at the level of the point $A_1$ around RPJ as a function of the azimuth $\alpha$ for a fixed elevation $\beta$ of the moving plate 20. Similarly, FIG. 11 is a graphic illustration of the angle of rotation of the jack 1 at the level of the point $A_1$ around RSJ as a function of the azimuth $\alpha$ for a fixed elevation $\beta$ of the moving plate 20. And finally, FIG. 12 gives the relative angle of rotation between the two elements $L_A$ and $L_B$ of the jack 1 as a function of the azimuth a for a fixed elevation $\beta$ of the moving plate 20.

In FIG. 13 the hexapod turret 100 support a parabolic antenna 30, illustrated in a reference position. In this position, jacks 1, 2, 3, 4, 5 and 6 are all adjusted to the same length $L_0$. In this configuration the centre OB is situated at the vertical of the centre OA on the vertical axis $z_0$. The reference position can also be selected as a virtual position of the turret. For example, the reference position can be defined as a position for which the jacks would assume a length $L_0$ greater than the length they can achieve mechanically.

As shown in FIG. 14, a frame $R_0$ is defined attached to the base 10, of centre OA and axes ($x_0$, $y_0$, $z_0$). In this frame $R_0$ the position of the moving plate 20 can be wholly determined by the position of its centre OB and a pointing direction V defined by an azimuth $\alpha$ and an elevation $\beta$. The frame $R_{01}$ of centre OB and axes ($x_0$, $y_0$, $z_0$) is defined as the image by rotation of the frame $R_0$ relative to the axis $z_0$ and angle $\alpha$. In the same way the frame $R_{02}$ de centre OB and axes ($x_{02}$, $y_{02}$, $z_{02}$) is defined as the image by rotation of the frame $R_{01}$ relative to the axis $x_{01}$ and angle $\beta$. The frame $R_{02}$ is a fixed frame relative to the moving plate 20. The direction $x_{02}$ defines the pointing direction V in the frame $R_0$.

The hexapod structure en theory enables the moving plate 20 to be placed in space according to six degrees of liberty. However, certain positions lead to unstable configurations of the hexapod structure. FIG. 15 illustrates a hexapod turret 100 in a configuration approaching instability. In this figure the moving plate 20 is practically aligned with the jacks 1 and 2 (the angle between leg and normal to the plate attains the limit value of 80 degrees). The structure 100 loses its rigidity when the angles between its elements (angles between axes of the jacks 1 to 6 and perpendicular to the plane of the fixed base 10 or moving plate 20) approach 90 degrees. This phenomenon is particularly prejudiced whenever the structure is placed outside and likely to be exposed to difficult climatic conditions.

Given that the hexapod turret 100 is used to point equipment towards elements situated at considerable distances relative to the dimensions of the turret, there is interest only in orienting its plate 20 and not in the position thereof in the frame $R_0$.

The pointing direction V features the two orientation parameters $\alpha$ and $\beta$. An offset law d of the moving plate 20 is defined as a function of the pointing direction V to be pointed. For example, the variation in lengths $L_1$ to $L_6$ des legs 1 to 6 can be controlled so that the centre OB of the moving plate 20 moves according to a plane perpendicular to the axis $z_0$, that is, at a height z constant relative to the base 10. This plane defines the "offset surface" on which point OB should always be located. For a given pointing direction V, the point OB is offset by a certain distance d in the direction $x_{01}$ relative to its reference configuration illustrated in FIG. 13. The offset direction $x_{01}$ accordingly depends on the azimuth angle $\alpha$ and the offset distance d is a function of the elevation $\beta$ of the plate.

FIGS. 16 and 17 show examples of offset laws as a function of the elevation $\beta$. When these laws for positioning the moving plate 20 are respected, the hexapod turret 100 is situated in configurations where the angles between the axes of jacks 1 to 6 and the perpendicular to the plane of the fixed base 10 or moving plate 20 are always less than 45 degrees, for example (giving a safety margin of 45 degrees). These laws enable the turret 100 to be positioned far away from singular points of low rigidity.

Of course, there are numerous ways to define the offset d to be applied:

according to the type of offset surface on which the point OB moves: an offset surface can be chosen other than a plane, such as a portion of a sphere or ellipsoid, for instance, according to the law of positioning on this surface: an offset law d can, for example, be fixed as a function of the angle of elevation $\beta$.

There are, nevertheless, conditions to these choices. On the one hand, the lengths $L_i$ of the obtainable jacks i are limited. In fact, consideration should be given to the possible minimum and maximum elongations. On the other hand, the selected safety margin concerning the angles between the elements should be respected. A maximum angle of 135 or 150 degrees, for example, can be selected.

FIG. 18 illustrates displacement of the moving plate 20 of the turret 100. To displace the moving plate 20 of the hexapod turret 100 from a pointing direction $V_1=(\alpha_1, \beta_1)$ towards a pointing direction $V_2=(\alpha_2, \beta_2)$ close to $V_1$, the procedure is as follows:

In a first stage the frame $R_{02}$ is considered to be oriented such that $x_{02}=V_2$. In this frame $R_{02}$ a virtual axis of rotation RH of direction $y_{02}$ and passing through a point PRH fixed on the axis $z_0$ is considered. Virtual rotation of the moving plate 20 of axis RH and of angle $\beta_2$—90° is made. This rotation enables the passage from the reference position of the turret (plate oriented to the zenith) to the position corresponding to the pointing direction $V_2$. As described hereinabove, the reference position can be virtual.

In a second stage the offset of the moving plate (20) is determined according to the direction of azimuth $\alpha_2$ owing to the offset law and from this is deduced the position of the points $A_1$ to $A_6$ and $B_1$ to $B_6$ in this configuration. To this end, a virtual translation of the moving plate 20 is made allowing the point OB to be reduced on the offset surface. The lengths $L_1$ to $L_6$ of the legs 1 to 6 of the hexapod 100 are determined in this position of the plate 20. From this is deduced the elongation of each leg 1 to 6 required to move from orientation $V_1$ to $V_2$ with offset.

To move the plate 20 from $V_1$ to $V_2$ in a time t determined (for example t=1 second), each length-adjusting device of leg i must adjust elongation of the jacks of $\Delta L_i$. An elongation speed of each jack i of $\Delta L_i/t$ (linear interpolation) is controlled, for example.

When the displacement of the plate 20 becomes too significant (for example displacement from $V_1$ to $V_2$ is greater than 1°) the turret 100 risks passing through a singular point. To avoid these singular points, displacement of the plate 20 from $V_1$ to $V_2$ can be organised in a series of unit displacements of azimuth $\Delta\alpha$ and elevation $\Delta\beta$. Each unit displacement allows switching from a pointing direction $V_i$ to a pointing direction $V_{i+1}$ close to $V_i$. For each unit displacement elongation of the jacks is calculated thanks to two successive virtual transformations (a virtual rotation followed by a virtual translation), as already described. In this way the plate 20 is moved according to a series of positions corresponding to pointing directions $V_1, \ldots V_i, V_{i+1} \ldots V_2$ showing a spread of $\Delta\alpha$ and $\Delta\beta$. The values of $\Delta\alpha$ and $\Delta\beta$ are selected sufficiently low for the plate 20 never to be able to pass through singular points or configurations impossible to create physically. In fact, the more $\alpha$ and $\beta$ are low, the less the successive positions OB of the plate 20 will be able to approach a singular point.

FIGS. 19 and 20 illustrate the successive positions of the pointing direction $V_i$. These positions are for example chosen with successive deviations of 1°. The unit trajectory of the orientation vector $V_i$ between two successive positions corresponds to a rotation of axis perpendicular to the plane containing the two successive orientations. The successive positions of $V_i$ may follow a direct overall trajectory corresponding to a rotation of axis perpendicular to $V_{1\ and\ V2}$ as illustrated in FIG. 19 or any overall trajectory as illustrated in FIG. 20.

Of course, there is an infinite number of methods for characterising the pointing direction V according to marking systems and conventions used. The process of the invention is not limited to pointing characterisation by its azimuth and elevation. In addition, even though this coordinates system is used to define the pointing direction V, the azimuth and elevation rotations are not necessarily reproduced mechanically. Different rotations and translations resulting in the pointing direction defined in azimuth and in elevation can be adjusted.

The effect of the process of displacing the moving plate 20 of the hexapod 100 previously described is to connect rotation of the moving plate 20 about its own axis $x_{02}$ to its azimuth rotation around the axis $z_0$ attached to the base 10. When the moving plate 20 is displaced from one pointing direction $V_1=(\alpha_1, \beta_1)$ towards a pointing direction $V_2=(\alpha_2, \beta_2)$, it turns around the axis $z_0$ of an azimuth angle $\alpha_2-\alpha_1$. With the abovedescribed process the moving plate 20 permanently compensates this azimuth rotation by rotating around its own axis $z_{02}$ of angle—$(\alpha_2-\alpha_1)$. Accordingly, the result is that the overall rotation of the moving plate 20 around the axis $z_0$ is always zero.

The advantage of this process for example is that electric cables attached to the device 30 mounted on the moving plate 20 and connecting this device to the ground are never subjected to torsion during displacement of the moving plate 20. This characteristic allows continuous rotation of the moving plate 20 around the azimuth axis $z_0$ to be controlled without risking damaging the mechanism of the hexapod 100. Furthermore, the displacement device of the moving plate does not need a pivoting joint.

Another advantage of this process is that it allows continuous control of good functioning of the displacement device. In effect, where one of the length-adjusting devices of the leg or one of the jacks might be deficient, it is sometimes difficult to notice an anomaly in the functioning of the hexapod. The stops of the jacks are in such a case the only contrivance likely to stop the displacement device in its movement. All the same, because the law of movement is no longer being respected, the hexapod structure risks passing through singular points leading to inevitable damage to the universal joints.

In the interests of avoiding these risks the orientation device comprises means for ensuring that the overall rotation of the moving plate 20 around the axis $z_0$ is always zero.

To this end FIG. 21 illustrates an example of such control means. These means comprise a cable 80 connecting the centre OB of the moving plate 20 to the centre OA of the fixed base 10. This cable 80 has properties of suppleness in flexion and rigidity in torsion. It is connected at a first end to the centre OB of the moving plate 20 via a rigid link and at a second end to the centre OA of the fixed base 10 via a pivot link 82. The cable 80 is fitted at this second end with an indicator element 84. When the orientation device of the hexapod 100 is operating normally the second end of the cable 80 is always fixed relative to the base 10 and the indicator element 84 is in contact with a detection circuit 86.

In the event of a deficiency of one of the length-adjusting devices of the legs 1, 2, 3, 4, 5, or 6 or deficiency in one of the jacks, rotation of the plate 20 around the axis $z_0$ generates rotation of the cable 80 relative to the base 10. This rotation drives rotation of the indicator element 84 which is no longer in contact with the detection circuit 86. The detection circuit 86 detects this cut in contact and sends an alert signal to a control device of the leg-adjusting devices. In response to this signal the control device halts movement of the hexapod 100.

It is understood that other types of control means could be used here.

The invention claimed is:

1. A process for moving a moving plate (20) of a hexapod (100) whose legs (1, 2, 3, 4, 5, 6) are fitted with a length-adjusting device, from an orientation $V_1$ defined by its azimuth-elevation $(\alpha_i, \beta_i)$ coordinates towards an orientation $V_{i+1}$ defined by its azimuth-elevation $((\alpha_{I+1}, \beta_{I+1})$ coordinates, characterised in that it comprises stages wherein:

a law is defined which defines an offset distance d according to the orientation of the plate (20), the offset distance corresponding to the orientation $V_{i+1}$ is determined, the length adjustment device is controlled in order to modify lengths $L_1$ to $L_6$ of the legs (1, 2, 3, 4, 5, 6) in order to displace the moving plate (20) from orientation $V_i$ to orientation $V_{i+1}$ and to offset it in relation to the perpendicular on a fixed base (10) of the hexapod (100) passing through a centre OA of said base (10), in the azimuth plane of $V_{i+1}$ of the distance d.

2. The process as claimed in claim 1, characterised in that an offset law is defined giving a unique position of a centre OB of the plate in space as a function of its orientation.

3. The process as claimed in claim 2, characterised in that the offset law defines a continuous geometric surface.

4. The process as claimed in claim 3, characterised in that the offset surface is a plane.

5. The process as claimed in claim 3, characterised in that the offset surface is a portion of a sphere.

6. The process as claimed claim 1, wherein the moving plate (20) is moved by controlling rotation of the moving plate (20) around an axis perpendicular to a plane containing the pointing vectors $V_i$ and $V_{i+1}$.

7. The process as claimed in claim 2, wherein a variation in length of the legs (1, 2, 3, 4, 5, 6) of the hexapod (100) is determined according to the following stages:

a reference position of the hexapod (100) is defined according to which all the legs (1, 2, 3, 4, 5, 6) are adjusted to a length $L_0$, the variation in length of each leg (1, 2, 3, 4, 5, 6) is determined so that the moving plate (20) of the hexapod (100) moves from the reference position to the pointing direction $V_{i+1}$ by virtual rotation in the plane of azimuth $_{i+1}$, and by virtual translation of the centre OB of the plate (20) towards an offset surface defined by the offset law, a variation in total length is deduced therefrom for each leg (1, 2, 3, 4, 5, 6) to switch from direction $V_i$ to direction $V_{i+1}$.

8. The process as claimed in claim 1, wherein the overall orientation movement of the moving plate (20) is organised in a succession of unit displacements of azimuth $\Delta\alpha$ and elevation $\Delta\beta$ of the moving plate (20).

9. The process as claimed in claim 1, wherein the adjustment devices are controlled as a function of the lengths $L_i$ of the legs (1, 2, 3, 4, 5, 6) to be obtained and in that this calculation takes into consideration relative angles between the elements making up links joining the legs (1, 2, 3, 4, 5, 6) to the plate (20) and to the fixed base (10).

10. The process as claimed in claim 9, characterised in that the relative angles between the elements making up the links connecting the legs (1, 2, 3, 4, 5, 6) to the plate (20) and to the base (10) are determined from positions of linking points calculated between the legs (1, 2, 3, 4, 5, 6) and the plate (20), and from this relative rotations between the sliding assemblies of the jacks is deduced.

11. The process as claimed in claim 10, characterised in that each leg (1, 2, 3, 4, 5, 6) of the hexapod (100) comprises a jack constituted by two assemblies sliding relative to one another and an actuator (61) whose exit axis (62) drives in rotation a screw (65) making up a helicoidal link between the sliding assemblies, in that an additional elongation of each jack is deduced due to the relative rotations between its sliding assemblies ($L_A$, $L_B$) as a function of the geometric characteristic of the helicoidal link, and in that this additional elongation is taken into account for establishing a set-point for controlling the actuator (61).

12. The process as claimed in claim 1, wherein angles formed by the axes of the legs (1, 2, 3, 4, 5, 6) and the perpendicular to the plane of the fixed base (10) and the angles formed by the axes of the legs (1, 2, 3, 4, 5, 6) and the perpendicular to the plane of the moving plate (20) are always less than a maximum angle defined between 40 and 80 degrees.

13. The process as claimed in claim 1, wherein there is continuous verification that the overall rotation of the moving plate (20) relative to the vertical to the fixed base (10) is zero.

14. The process as claimed in claim 13, characterised in that when it is detected that the overall rotation of the moving plate (20) relative to the vertical to the fixed base (10) is no longer zero a command is generated to stop the movement of the hexapod (100).

15. A device for displacing the moving plate (20) of a hexapod (100), characterised in that it comprises control means for implementing the process as claimed in any one of the preceding claims.

16. The device as claimed in claim 15, characterised in that each leg (1, 2, 3, 4, 5, 6) of the hexapod (100) comprises a jack comprising a first and a second assembly ($L_A$, $L_B$) capable of sliding relative to one another, an actuator (61) whose output axis (62) drives in rotation a screw (65) placed perpendicularly in the axis (62) of a motor (61), said screw (65) extending over the length of the first assembly ($L_A$) and capable of pivoting inside a nut (66) mounted solid with the second assembly ($L_B$), rotation of the screw (65) in the nut (66) driving translation of the second assembly ($L_B$) relative to the first assembly ($L_A$).

17. The device as claimed in claim 16, characterised in that the control means are intended to determine any additional elongation of each jack due to the relative rotations between its sliding assemblies ($L_A$, $L_B$) as a function of the geometric characteristics of the helicoidal link, and to take into account this additional elongation to establish a set-point to control the actuator (61).

18. The device as claimed in claim 16, characterised in that it comprises means for measuring the position of the axis (62) of the actuator (61).

19. The device as claimed in claim 15, wherein links are arranged on the fixed base (10) according to a first circle of radius RA and links are arranged on the moving plate (20) according to a second circle of radius RB, the RA/RB ratio being substantially equal to 1.5.

20. The device as claimed in claim 15, wherein the links are arranged in pairs on the moving plate (20) or on the fixed base (10) in accordance with a circle of radius R, the distance between two links of the same pair being substantially equal to R/10.

21. The device as claimed in claim 15, wherein the maximum elongation of a leg is less than or equal to 2.

22. The device as claimed in claim 15, wherein the maximum elongation of a leg is greater than or equal to 1.7.

23. The device as claimed in claim 15, further comprising means for verifying that the overall rotation of the moving plate (20) relative to a vertical to the fixed base (10) is zero.

24. The device as claimed in claim 23, characterised in that it comprises an element rigid in torsion connected at a first end, to the moving plate (20) via a rigid link and at a second end, to the fixed base (10) via a pivoting link, as well as means for detecting rotation of the second end of the element relative to the base (20).

25. The device as claimed in claim 24, characterised in that the rotation detecting means comprise an indicator element fixed at the second end of the cable as well as a detection circuit, and in that when the second end of the cable is fixed relative to the base (10) the indicator element makes contact with the detection circuit and when the second end of the cable turns relative to the fixed base (10), the indicator element breaks this contact.

* * * * *